US009579722B1

(12) United States Patent
Alvin et al.

(10) Patent No.: US 9,579,722 B1
(45) Date of Patent: Feb. 28, 2017

(54) METHOD OF MAKING AN APPARATUS FOR TRANSPIRATION COOLING OF SUBSTRATES SUCH AS TURBINE AIRFOILS

(71) Applicants: Mary Anne Alvin, Pittsburgh, PA (US); Iver Anderson, Ames, IA (US); Andy Heidlof, West Des Moines, IA (US); Emma White, Ames, IA (US); Bruce McMordie, Perkasie, PA (US)

(72) Inventors: Mary Anne Alvin, Pittsburgh, PA (US); Iver Anderson, Ames, IA (US); Andy Heidlof, West Des Moines, IA (US); Emma White, Ames, IA (US); Bruce McMordie, Perkasie, PA (US)

(73) Assignee: U.S. Department of Energy, Washington, DC (US)

( * ) Notice: Subject to any disclaimer, the term of this patent is extended or adjusted under 35 U.S.C. 154(b) by 130 days.

(21) Appl. No.: 14/596,307

(22) Filed: Jan. 14, 2015

(51) Int. Cl.
*B22F 1/00* (2006.01)
*B22F 3/11* (2006.01)
(Continued)

(52) U.S. Cl.
CPC ..... *B22F 1/0062* (2013.01); *B22F 3/1143* (2013.01); *C22C 19/058* (2013.01);
(Continued)

(58) Field of Classification Search
CPC ..... B22F 3/1007; B22F 2998/00; B22F 2998/10; B22F 2201/013; B22F 2201/03; B22F 2201/10; B22F 3/1121; B22F 3/1146
See application file for complete search history.

(56) References Cited

U.S. PATENT DOCUMENTS 3,052,967 A * 9/1962 Fischer ..... B22F 3/11 264/44
3,067,982 A 12/1962 Wheeler
(Continued)

OTHER PUBLICATIONS

Pieczonka et al., "Dimensional behaviour of aluminium sintered in different atmospheres," Materials Science and Engineering A 478 (2008) 251-256.

(Continued)

*Primary Examiner* — Jessee Roe
*Assistant Examiner* — Nicholas Wang
(74) *Attorney, Agent, or Firm* — Jacob A. Heafner; Michael J. Dobbs; Brian J. Lally

(57) ABSTRACT

A method and apparatus for generating transpiration cooling using an oxidized porous HTA layer metallurgically bonded to a substrate having micro-channel architectures. The method and apparatus generates a porous HTA layer by spreading generally spherical HTA powder particles on a substrate, partially sintering under $O_2$ vacuum until the porous HTA layer exhibits a porosity between 20% and 50% and a neck size ratio between 0.1 and 0.5, followed by a controlled oxidation generating an oxidation layer of alumina, chromia, or silica at a thickness of about 20 to about 500 nm. In particular embodiments, the oxidized porous HTA layer and the substrate comprise Ni as a majority element. In other embodiments, the oxidized porous HTA layer and the substrate further comprise Al, and in additional embodiments, the oxidized porous HTA layer and the substrate comprise $\gamma$-Ni+$\gamma'$-$Ni_3Al$.

17 Claims, 4 Drawing Sheets

(51) Int. Cl.
*C22C 19/05* (2006.01)
*B22F 3/24* (2006.01)

(52) U.S. Cl.
CPC ..... *B22F 2003/242* (2013.01); *B22F 2201/03* (2013.01); *B22F 2201/20* (2013.01); *B22F 2301/15* (2013.01)

(56) References Cited

U.S. PATENT DOCUMENTS

| | | | | |
|---|---|---|---|---|
| 3,647,316 | A | 3/1972 | Moskowitz | |
| 3,706,508 | A | 12/1972 | Moskowitz et al. | |
| 4,311,433 | A | 1/1982 | Bratton et al. | |
| 4,376,004 | A | 3/1983 | Bratton et al. | |
| 5,690,473 | A | 11/1997 | Kercher | |
| 6,375,425 | B1 | 4/2002 | Lee et al. | |
| 6,511,762 | B1 | 1/2003 | Lee et al. | |
| 7,829,012 | B2 | 11/2010 | Bischoff et al. | |
| 2014/0169943 | A1* | 6/2014 | Bunker | C23C 4/02 415/116 |

OTHER PUBLICATIONS

Schaffer, "Powder Processed Aluminium Alloys," Materials Forum vol. 28 (2004) 65-74.

Munir, "Analytical treatment of the role of surface oxide layers in the sintering of metals," Journal of Materials Science 14 (1979) 2733-2740.

* cited by examiner

METHOD OF MAKING AN APPARATUS FOR TRANSPIRATION COOLING OF SUBSTRATES SUCH AS TURBINE AIRFOILS

GOVERNMENT INTERESTS

The United States Government has rights in this invention pursuant to the employer-employee relationship of the Government to the inventors as U.S. Department of Energy employees and site-support contractors at the National Energy Technology Laboratory, and pursuant to DOE Contract No. DE-AC02-07CH11358 with Ames Laboratory.

FIELD OF THE INVENTION

A method of producing a oxidized porous HTA layer on a substrate using a sintering process followed by a controlled oxidation and the apparatus produced thereby, in order to provide transpiration cooling capability to components operating in high temperature environments.

BACKGROUND

Transpiration cooling of high temperature components such as turbine blades is relatively well known in the art. This type of cooling generally features flow of a cooling fluid from a substrate interior with subsequent flow of the fluid through a porous outer layer of the substrate. This cools the blade by transporting heat within the porous outer layer and additionally acts to provide a boundary layer on the exterior of the blade surface, greatly mitigating contact between hot motive gases and the underlying substrate.

Transpiration cooled substrates generally consist of a main load-carrying strut and an external shell surrounding the strut which is constructed to allow the passage of coolant. A variety of materials and fabrication techniques have been applied and utilized as the porous, outer layer necessary for this type of transpiration cooling. In some cases, the porous outer layer is constructed by wrapping a porous skin sheathing such as wire cloth or ceramic tape around framework or the underlying substrate surfaces. See e.g. U.S. Pat. No. 3,067,982 to Wheeler issued Dec. 11, 1962; see also U.S. Pat. No. 3,706,508 to Moskowitz et al. issued Dec. 19, 1972; see also U.S. Pat. No. 4,311,433 to Bratton et al. issued Jan. 19, 1982; and see also U.S. Pat. No. 4,376,004 to Bratton et al. issued Mar. 8, 1983, among others. In other cases, transpiration strips are attached to surfaces comprised of metering holes. See e.g. U.S. Pat. No. 5,690,473 to Kercher issued Nov. 25, 1997, among others. In other cases, the load bearing struts are fabricated of porous, sintered metal materials, and the porosity of the load bearing member provides transpiration capabilities. See e.g. U.S. Pat. No. 3,647,316 to Moskowitz issued Mar. 7, 1972, among others. These methods have been effective at lower temperatures, however in the higher temperature environments where operating temperatures may be 1400° to 1700° C., the high temperature alloys typically used in these techniques oxidize, and the minute transpiration flow paths become plugged. Additionally, and significantly, at relatively high temperatures within about 300 C. degrees of the melting temperature of these high temperature alloys, continued sintering of the material tends to eliminate interconnected porosities and render the item non-permeable, negating the items original functionality.

In light of these issues, thermally resistant ceramic materials such as yttrium-stabilized zirconia (YSZ) have also been employed to function as outer, porous layers in transpiration cooling arrangements for components intended for high temperature service. Generally these ceramic materials are applied to underlying substrates featuring cooling fluid metering holes or channels, and the ceramic coating is applied by various known methods such as PVD or plasma spray processes. The ceramic coating is applied to be porous, so cooling air is able to penetrate the coating passages spread inside the ceramic layer before exiting the through porous surface of the layer. See e.g. U.S. Pat. No. 6,375,425 to Lee et al. issued Apr. 23, 2002; see also U.S. Pat. No. 6,511,762 to Lee et al. issued Jan. 28, 2003, among others. However, like ceramic TBC coatings generally, these porous ceramic coatings do not adhere well when applied directly to typical superalloys used as the substrates, and adhesion mainly by mechanical keying to a roughened bond coat is generally relied on. This provides limited tensile strength to the coating in service and additionally results in significant susceptibility to delamination-type failures driven by oxides thermally grown during service.

It would be advantageous to provide a method of fabricating a transpiration cooled substrate using a sintered material capable of metallurgically bonding with the underlying substrate, so that tensile strength stemming from the metallurgical bond rather than mechanical keying could be employed. It would additionally be advantageous if a high sintering resistance could be imparted to the sintered material as part of the fabrication process, so that interconnected porosities and permeability could be maintained during high temperature service.

It is generally understood that the sintering of metallic particles can be hampered by the presence of native oxide layers, such as alumina. See e.g., Munir, "Analytical treatment of the role of surface oxide layers in the sintering of metals," *Journal of Materials Science* 14 (1979), among others. These oxide layers are tenacious and generally cannot be broken down or removed simply by heating during conventional sintering processes, and are generally dealt with through a variety of means during initial sintering, including reactive atmospheres, the addition of disrupting components such as Mg and Li, the use of liquid phase sintering, mechanical breakdown through friction techniques, ion bombardment treatments, and other means. See e.g. Xie et al., "Effect of Mg on the Sintering of Al—Mg Alloy Powders by Pulse Electric-Current Sintering Process," *Materials Transactions* 45 (2004), among others. This retarding tendency of oxide layers has also been utilized to preserve resulting porosities during subsequent high temperature service, by intentionally promoting the formation of thick oxide layers on metallic particles prior to initial sintering. See U.S. Pat. No. 7,829,012 to Bischoff et al. issued Nov. 9, 2010. This approach reports to generate enhanced thermal resistance, however it would be preferable to provide a method whereby an oxide layer could be used to impart sintering resistance following the completion of an initial sintering phase, in order to minimize disruptions to the solid-state bonding between particles during the initial phase.

Provided here is a method and apparatus whereby an oxidized porous HTA layer is metallurgically bonded to a substrate through partial sintering followed by an oxidizing step to generate an adherent oxide layer between 20-500 nm thick on the exposed surfaces of the partially sintered particles. The partial sintering phase allows high-strength particle-to-particle and particle-to-substrate bonding to occur in the relative absence of an oxidation layer, and the intentional generation of an oxide layer over the resulting exposed surfaces greatly mitigates any additional sintering of the porous layer that would otherwise be expected in a high temperature service environments. Transpiration cooling capability is provided via micro-channel openings in the surface of the substrate, so that transpiration cooling flows may arise from the micro-channel to flow through the interconnected porosity of the oxidized porous layer. The methodology thereby provides an article for transpiration cooling whereby the porous layer and the substrate are metallurgically bonded for enhanced strength in service while the generated oxidation layer over the exposed surfaces acts to maintain effective porosity during service life.

These and other objects, aspects, and advantages of the present disclosure will become better understood with reference to the accompanying description and claims.

SUMMARY

The disclosure provides a method and apparatus for generating transpiration cooling using a porous High Temperature Alloy (HTA) layers in conjunction with surface embedded micro-channel architectures. An oxidized porous HTA layer is metallurgically bonded to a substrate and in fluid communication with a micro-channel opening in the surface of the substrate, so that transpiration cooling flows may arise from the micro-channel to flow through the interconnected porosity of the oxidized porous HTA layer. In particular embodiments, the oxidized porous HTA layer and the substrate comprise Ni as a majority element. In a further embodiment, the oxidized porous HTA layer and the substrate comprise Ni as the majority element and further comprise Al, and in additional embodiment, the oxidized porous HTA layer and the substrate comprise $\gamma$-Ni+$\gamma'$-$Ni_3Al$.

The apparatus may be fabricated through a method which generally comprises applying a powder mixture on a substrate, where the powder mixture comprises generally spherical HTA powder particles between 50-400 μm in diameter and a binder. This is followed by partially sintering the powder mixture under $O_2$ vacuum to bind the HTA powder particles through neck formation and generate metallurgical bonding with the substrate. The partial sintering continues until the porous HTA layer atop the substrate exhibits a porosity between 20% and 50% a neck size ratio between 0.1 and 0.5. Bonding regions are present between the porous HTA layer and the substrate and are comprised of a first element from the substrate and a second element from the HTA powder particles. As a final step in the processing, the porous HTA layer and the substrate are subjected to a controlled oxidation in order to generate a oxidation layer of alumina, chromia, or silica at a thickness of about 20 to about 500 nm.

The formation of this oxidation layer over the exposed surfaces of the partially sintered particles and necks serves to mitigates additional sintering of the porous HTA layer which will otherwise be expected in a high temperature service environment, so that the specified porosity of the oxidized porous HTA layer and transpiration cooling can be maintained during high temperature service.

The novel method and apparatus and the principles of operation are further discussed in the following description.

DETAILED DESCRIPTION

Figure 1:
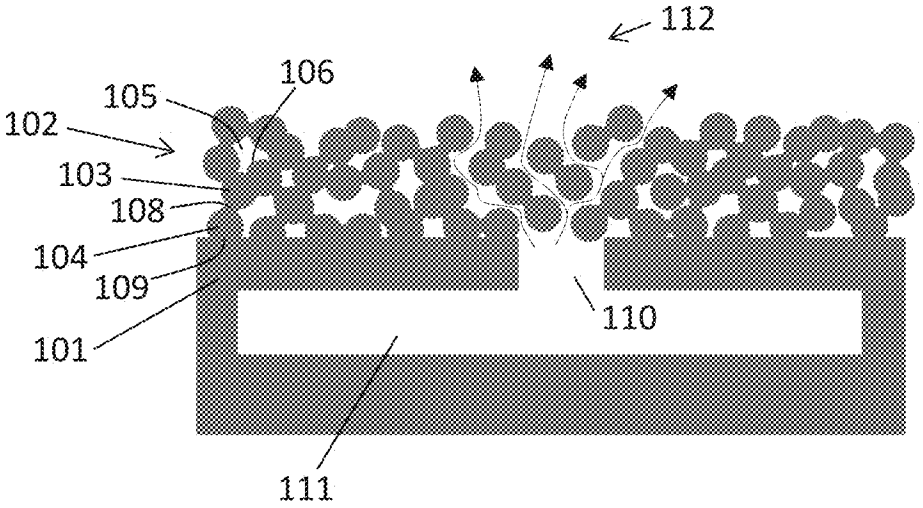
FIG. 1 illustrates an oxidized porous HTA layer on a substrate

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide an oxidized porous HTA layer metallurgically bonded to a substrate having cooling micro-channels for the provision of transpiration cooling.

The disclosure provides a method and apparatus for generating transpiration cooling using a porous high temperature alloy layers in conjunction with surface embedded micro-channel architectures. An oxidized porous High Temperature Alloy (HTA) layer is metallurgically bonded to a substrate and in fluid communication with a micro-channel opening in the surface of the substrate, so that transpiration cooling flows may arise from the micro-channel to flow through the interconnected porosity of the oxidized porous HTA layer, in order to effectively remove heat and maintain the substrate at a reduced temperature. The apparatus may be fabricated through a method which generally comprises applying a powder mixture on a substrate, where the powder mixture comprises generally spherical HTA powder particles between 50-400 μm in diameter and a binder, followed by partially sintering the powder mixture under $O_2$ vacuum until the porous HTA layer atop the substrate exhibits a porosity between 20% and 50%, and until the neck size ratio of the porous HTA layer is at least 0.1 and generally less than 0.5, and until the substrate and the porous HTA layer are metallurgically bonded at bonding regions. The bonding regions are present between the porous HTA layer and the substrate and exhibit a conformance of lattice structures from the partially sintered particles of the porous HTA layer to the substrate, and are comprised of a first element from the substrate and a second element from the HTA powder particles. As a final step in the processing, the porous HTA layer and the substrate are subjected to a controlled oxidation in order to generate a oxidation layer of alumina, chromia, or silica at a thickness of about 20 to about 500 nm. The formation of this oxidation layer under the conditions specified greatly mitigates additional sintering of the porous HTA layer which will otherwise be expected in a high temperature service environment. By providing the oxidation layer as specified, the method and apparatus disclosed here provides an oxidized porous HTA layer on the substrate such that the specified porosity of the layer allows transpiration cooling during high temperature service while the thin oxidation layer acts to maintain this porosity during service life, due to the tendency of the oxidation layer to mitigate the additional sintering in service that would otherwise be expected. The series of steps identified above will be further discussed in greater detail.

The apparatus generated by the method disclosed is generally described with reference to FIG. 1. At FIG. 1, a substrate 101 and an oxidized porous HTA layer generally indicated at 102 are metallurgically bonded at bonding regions such as that indicated at 109. Oxidized porous HTA layer 102 comprises a plurality of partially sintered particles with an average diameter generally between 50 and 400 μm, and the partially sintered particles are bonded to other, adjacent particles by necks which form during a partial sintering process, such as neck 108 between individually sintered particles 103 and 104. The necks between particles provide an average neck size ratio of at least 0.1 and less than 0.5 and oxidized porous HTA layer 102 has an interconnected, permeable porosity of from about 20% to about 50%, and typically about 30-50%. Additionally, throughout oxidized porous HTA layer 102, the pore surfaces such as pore surface 106 are covered with an oxidation layer of alumina, chromia, or silica at a thickness of from about 20 nanometers to about 500 nanometers, typically less than 100 nanometers. The oxidation layer greatly mitigates the additional sintering of the porous HTA layer which would otherwise be expected in a high temperature service environment. By mitigating this additional sintering and metallurgically bonding the porous HTA layer and the substrate, the apparatus at FIG. 1 provides sufficient strength and sintering resistance to provide consistent transpiration cooling flows under high temperature service environments. For example, transpiration cooling flows such as those generally indicated at 112 may arise from interior channel 111 and micro-channel 110 to flow through the interconnected porosity of oxidized porous HTA layer 102, in order to effectively remove heat and maintain substrate 101 at a reduced temperature.

The oxidized porous HTA layer bonded to the substrate may be fabricated using a series of steps including:

(i) Obtaining a powder mixture of HTA powder particles and a binder, where the HTA powder particles have a equivalent spherical diameter generally between 50-400 μm;

(ii) Applying the powder mixture to a surface of the substrate to generate a powder mixture layer and covered substrate;

(iii) Debinding the powder mixture layer and generating a debinded layer to generate a debinded covered substrate;

(iv) Partially sintering the debinded substrate at less than 1 ppm $O_2$ until the debinded layer exhibits a porosity generally between 20-50% and a neck size ratio generally between 0.1 and 0.5, thereby generating a porous HTA layered substrate, and;

(v) Oxidizing the porous HTA layered substrate in an atmosphere between 1-10000 ppm $O_2$ until an oxidation layer thickness is between 20-500 nm, thereby generating the oxidized porous HTA layer on the substrate.

The above steps may be utilized to produce the oxidized porous HTA layer structurally bonded to the substrate as described herein and as discussed below.

Obtaining a Powder Mixture of HTA Powder Particles and a Binder:

As discussed, the powder mixture is comprised of a mixture of HTA powder particles and a binder. The HTA powder particles have an equivalent spherical diameter of less than about 400 μm. In a particular embodiment, the HTA powder particles have the equivalent spherical diameter greater than 50 μm. Preferably the equivalent spherical diameter is from about 75 μm to about 150 μm, and more preferably from about 100 μm to about 125 μm. Equivalent spherical diameters of less than about 50 μm are unlikely to provide an oxidized porous HTA layer possessing sufficient sintering resistance in a service environment, as will be discussed. This particular sizing allows formation of necks having an average neck size ratio of 0.1-0.5 during partial sintering such that the oxidized porous HTA layer possesses sufficient strength in the service environment, while concurrently providing a porosity of 20-50%, and more typically 30-50%. Additionally, the HTA powder particles have a span equal to less than 0.8, where the span is equal to $(D_{v(0.9)}-D_{v(0.1)})/D_{v(0.5)}$, where a term $D_{v(x)}$ represents a volume median diameter where x % of a volume distribution of particles has a volume median diameter less than the $D_{v(x)}$. A span less than about 0.8 provides a plurality of HTA powder particles where the significant majority of particles have an individual equivalent spherical diameter within about 40% of the mean. Additionally, the HTA powder particles have a sphericity of from about 0.8 to about 1.2. The relatively uniform particle size distribution and sphericity allows the HTA powder particles to provide a relatively uniform interconnected porosity during the partial sintering step.

The HTA powder particles may be a unimodal plurality of particles having a generally uniform size, or may be a polydisperse mixture of particles. The HTA powder particles may be comprised of any combination of individual groups of particles where each individual group has an associated mean diameter, provided that the resulting combination of the individual groups meets the equivalent spherical diameter, span, and sphericity requirements for the HTA powder particles discussed above. For example, the HTA powder particles may be a combination of a first group of particles having a mean diameter $D_1$ and a second group of particles having a diameter $D_2$, where the first group and the second group are mixed in such proportion that the resulting the HTA powder particles display the equivalent spherical diameter, span, and sphericity discussed above. Typically the HTA powder particles are unimodal or bimodal, although this is not a requirement.

The equivalent spherical diameter of the HTA powder particles is additionally significant in term of the characteristics of the finished oxidized porous HTA layer. The oxidized porous HTA layer on the substrate described herein is primarily intended to provide transpiration cooling capability in high temperature environments generally exceeding about 1300° C. An known issue with porous, sintered materials under such high temperature conditions is the continued, in-situ sintering of constituent particles which continues once in high-temperature service. In applications such as that disclosed here, this operational sintering acts to reduce porosities and degrade or eliminate the favorable advantages which depend upon that porosity, such as a transpiration cooling capability. The use of HTA particles having an equivalent spherical diameter of at least 50 μm provides a lowered driving force for operational, in-situ sintering in high temperature service, and greatly mitigates or eliminates subsequent degradations in the specified porosity by reducing the resultant sintering stress.

Within this disclosure, the term "equivalent spherical diameter" means a diameter based on replacing a given particle with an imaginary sphere having a property identical with the particle, and includes volume based particle size, weight based particle size, area based particle size, and hydrodynamic/aerodynamic particle size definitions. The equivalent spherical diameter may be determined through means known in the art, such as laser diffraction, sieve analysis, optical granulometry, electron micrograph, or others. Typically, the diameter specifications of this disclosure will be met through a sizing specification provided by a manufacturer of powder particles, where the manufacturer provides size data based on one of the methods delineated above and executed in accordance with ISO or other standardizing bodies.

The HTA powder particles are comprised of an oxidizing element of aluminum, chromium, silicon or mixtures thereof, and an individual HTA powder particle is at least 5 wt. % of the oxidizing element. This wt. % provides sufficient presence of the oxidizing element within the HTA powder particle so that a sufficient driving force is established for diffusion of the oxidizing element during the oxidizing step of the method. In a particular embodiment, the HTA powder particles comprise Ni as a majority element in the HTA powder particles. Here "majority element in the HTA powder particles" means the element having the highest wt. % presence in the HTA powder particles. In a further embodiment, the HTA powder particles comprise Ni as the majority element and further comprise Al. In an additional embodiment, the HTA powder particles comprise γ-Ni+γ'-$Ni_3Al$. In another embodiment the HTA powder particles are an ODS alloy further comprised of less than 10 wt. % $Y_2O_3$ dispersions. In a still further embodiment, the HTA powder particles comprise Ni as a majority element, at least 10 wt. % Al, at least 5 wt. % Cr, and comprise γ-Ni+γ'-$Ni_3Al$. The HTA powder particles are additionally comprised of a first element capable of forming a solid solution with a second element in the substrate under the partial sintering conditions, as will be discussed. The first element may be the majority element, an alloying element, the oxidizing element, or another element within the HTA powder particle composition.

The binder is present in the powder mixture at less than about 40 wt. % of the powder mixture, and more typically from about 2 wt. % to about 20 wt. % of the powder mixture. The binder may be any binder known in the art for the sintering of the HTA powder particles described here. In an embodiment, the binder comprises poly(propylene carbonate), poly(alkylene carbonate), polyvinyl alcohol (PVOH), or methylcellulose. Preferably the binder does not leave a significant amount of detrimental impurities such as carbon following the debinding step. Typically the binder is an organic binder. The powder mixture is generally a homogenous mixture of the HTA powder particles and the binder, and has a viscosity allowing direct application to the substrate with a spreading blade, trowel, or low velocity sprayer.

The substrate comprises a metal alloy comprising a majority element and alloying elements. In an embodiment, the majority element in the substrate is Ni, where "majority element in the substrate" means the element having the highest wt. % presence in the substrate. In a further embodiment, the substrate comprises Ni as the majority element and further comprises γ-Ni+γ'-$Ni_3Al$. In a still further embodiment, the substrate comprises Ni as a majority element, at least 10 wt. % Al, at least 5 wt. % Cr, and comprises γ-Ni+γ'-$Ni_3Al$. The substrate also comprises a second element capable of forming a solid solution with the first element in the HTA powder particles under the partial sintering conditions. The second element may be the majority element, an alloying element, or another element within the substrate composition. The substrate further comprises a nonporous substrate surface upon which the powder mixture is directly applied. The substrate is further comprised of a micro-channel in fluid communication with the surface of the substrate.

Applying the Powder Mixture and Generating a Covered Substrate:

The powder mixture is applied to the substrate surface in sufficient quantity to generate a powder mixture layer having a layer thickness, where the layer thickness is greater than at least 10 times the equivalent spherical diameter of the HTA powder particles comprising the powder mixture. In an embodiment, the layer thickness is at least 10 times and less than about 40 times the equivalent spherical diameter of the HTA powder particles. Layer thicknesses less than about 10 times the equivalent spherical diameter can tend to produce an oxidized porous HTA layer with insufficient isotropy, such that the strength of the oxidized porous HTA layer may be directionally dependent. Additionally, layers less than about 10 times the equivalent spherical diameter may be unable to adequately accommodate off-mean diameters within the powder mixture, generating weak spots within resulting oxidized porous HTA layer. In certain embodiments where the substrate is further comprised of the micro-channel, the micro-channel is at least partially filled with a fugitive material and the powder mixture is additionally applied to the fugitive material, so that the fugitive material is additionally covered with a similar layer thickness. Here, "layer thickness" denotes a displacement generally perpendicular to the substrate, and means a first displacement measured along a y-axis, where the y-axis is has a direction perpendicular to a plane defined by a first point, a second point, and a third point on the non-porous surface of the substrate, where the first point, the second point, and the third point are separated by at least 500 μm. In an embodiment, the powder mixture is applied to generate a layer thickness of from about 0.5 mm to about 2 mm in order to generate an appropriate layer thickness relative to the equivalent spherical diameters specified. Within the methodology disclosed, application of the powder mixture generates a covered substrate, where the covered substrate is comprised of the substrate and a powder mixture layer contacting the surface of the substrate and having the layer thickness as described.

Debinding the Powder Mixture Layer and Generating a Debinded Layer and Debinded Covered Substrate:

Following application of the powder mixture, the thus produced covered substrate is subjected to a debinding temperature in order to volatize the binder comprising the powder mixture layer. As is understood, the appropriate debinding temperature and time are based on the binder utilized and may be determined by a manufacturer's recommendation, past practice, or some other means known in the art. Within this disclosure, any temperature and time may be utilized provided the temperature and time is sufficient to cause at least 90 wt. % and preferably at least 99 wt. % of the binder constituents to exit the powder mixture layer as a vapor. Within the methodology disclosed, the debinding transforms the powder mixture layer to a debinded layer and generates a debinded substrate, where the debinded substrate is comprised of the substrate and the debinded layer contacting the surface of the substrate.

Partially Sintering the Debinded Substrate and Generating a Porous HTA Layered Substrate:

Following the debinding, the thus produced debinded substrate is then partially sintered by exposure to a first temperature and a first atmosphere, where the first temperature is from about 0.6 to about 0.95 of the solidus temperature of the HTA powder particles, and the first atmosphere is an atmosphere having an oxygen content of less than 1 ppm. In an embodiment, the first temperature is greater than 1000° C., and in another embodiment, the first temperature is less than 1300° C. The partial sintering continues until the debinded layer forms a porous HTA layer, where the porous HTA layer exhibits a porosity of greater than about 10% and less than about 50% and exhibits an average neck size ratio of at least 0.1 and less than 0.5. Typically the porous HTA layer exhibits a porosity between 30-50%. Within the range of HTA powder particle sizes discussed herein, average neck size ratios less than about 0.1 generally provide insufficient strength, while average neck size ratios greater than about 0.5 generally provide insufficient porosity. In an embodiment, the porous HTA layer has a volume shrinkage of less than 5% compared to the powder mixture layer.

Figure 2:
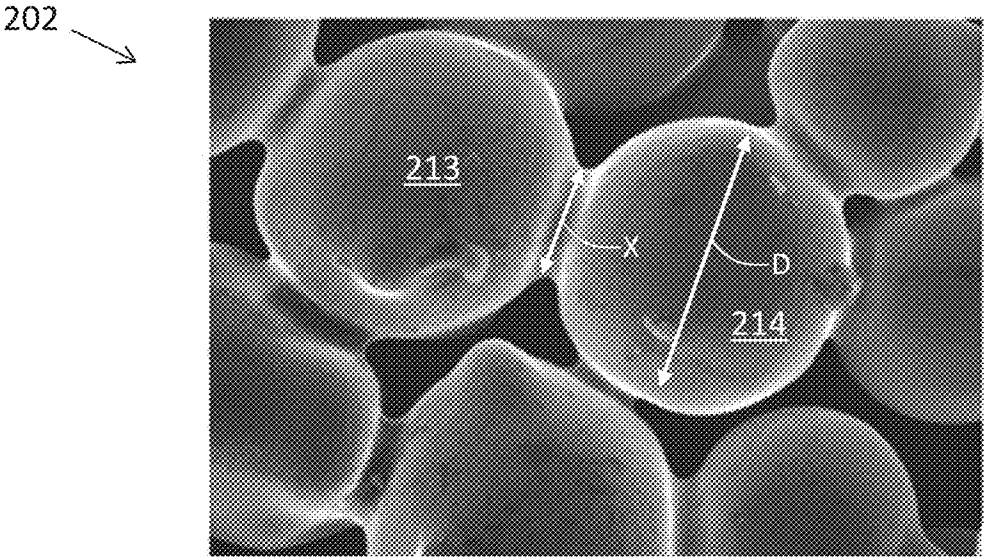
FIG. 2 illustrates a partially sintered porous HTA layer.

Here, "neck size ratio" means the ratio of a neck size X within the HTA porous layer to an equivalent spherical diameter of a partially sintered particle in a porous HTA layer. For example, FIG. 2 illustrates partially sintered particles 213 and 214 in a porous HTA layer generally indicated at 202. As shown, partially sintered particles 213 and 214 are joined by a neck having a size indicated as X. The neck size ratio with respect to the neck between partially sintered particles 213 and 214 is expressed as X/D, where D is the equivalent spherical diameter of the smaller partially sintered particle—for example, the equivalent spherical diameter D of partially sintered particle 214 at FIG. 2. Similarly, an "average neck size ratio" means an average value of X/D over at least 50 observed necks in the porous HTA layer. In an embodiment, the at least 50 necks join a plurality of partially sintered particles such that the plurality of partially sintered particles form a rigid system of particles and the distance between all pair of particles is constant. See e.g., Millard F. Beatty, *Principles of Engineering Mechanics: Volume* 2 *Dynamics—The Analysis of Motion* (2006). In another embodiment, the at least 50 observed necks are all present within a specific volume sufficient to contain at least 100 randomly packed spheres and equal to 100 times $(4/3\pi r_s^3)$ divided by 0.64, where $r_s$ is one-half the equivalent spherical diameter of the HTA powder particles.

Necks may be observed and measured using quantitative metallography methods known in the art, such as scanning electron microscopy. Porosity may be determined by various means known in the art, such as mercury porosimetry, pycometry, permeatry, or microscopy techniques, among others.

Figure 3:
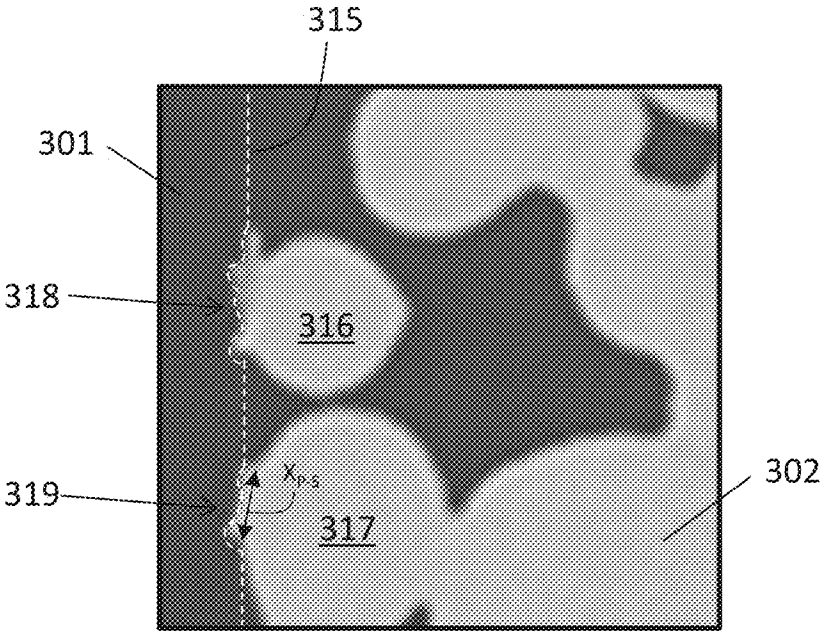
FIG. 3 illustrates partially sintered particles metallurgically bonded to a substrate.

Additionally and significantly, the debinded substrate is partially sintered until the the substrate and the porous HTA layer are metallurgically bonded by an admixture of a first metal comprising the HTA powder particles and a second metal comprising the substrate. The metallurgical bonding occurs where some of the partially sintered particles comprising the porous HTA layer contact the surface of the substrate at bonding regions. In the bonding regions, admixtures of the first and second metal join through a conformance of lattice structures, so that the partially sintered particles and the surface of the substrate join without dependence on intermediate layers such as adhesives or braze metals. For example, FIG. 3 illustrates a substrate 301 and a porous HTA layer 302, where partially sintered particles 316 and 317 comprise porous HTA layer 302 and the surface of substrate 301 is represented at 315. At FIG. 3, partially sintered particle 316 is metallurgically bonded to substrate 301 at a bonding region generally indicated by 318, and partially sintered particle 317 is metallurgically bonded to substrate 301 at a bonding region generally indicated by 319. These metallurgically bonded regions are generally characterized by concentration gradients of the first element and the second element over the bonding region and a conformance of lattice structures over the bonding region, so that the lattice structures over the bonding region gradually change from the lattice and composition of the substrate to the lattice and composition of the partially sintered particle. Such metallurgical bonding present at locations where porous HTA layer 302 contacts substrate 301 provides significant structural capability to the porous HTA layer. Generally where partially sintered particles are metallurgically bonded to a substrate, grain boundaries have migrated to either the partially sintered particle or the substrate. It is desirable that the grain boundary migrate outside the neck region to avoid potential weak spots in the resulting microstructure. Such grain boundary migration may be observed using means known in the art, such as scanning electron microscopy (SEM). In an embodiment, grain boundaries have migrated to either the partially sintered particle or the substrate over at least 50 bonding regions. In another embodiment, the at least 50 observed bonding regions are all present within a specific volume sufficient to contain at least 100 randomly packed spheres and equal to 100 times $(4/3\pi r_s^3)$ divided by 0.64, where $r_s$ is one-half the equivalent spherical diameter of the HTA powder particles.

Here, "admixture" with respect to the first metal and the second metal means the metals are intermixed in a bonding region, and may further connote a solid solution, an alloy, or a metallic phase. The admixture may include a concentration gradient of the first metal or the second metal and may additionally comprise an intermetallic or insoluble structure, crystal, or crystallite. In an embodiment, the admixture excludes distinguishable grains of compositions that can form a solid solution, a single metallic phase or the like, for example by heating the admixture to a temperature where the grains of compositions could inter-diffuse.

In an embodiment, metallurgical bonding is generated by conducting the partial sintering at the first temperature for a period of time at least sufficient to generate atomic diffusion of the first metal from the HTA powder particles or the second metal from the substrate or both over a distance of at least one-half of the equivalent spherical diameter of the HTA powder particles. Methods to determine such times are known in the art using diffusion coefficients and other data. For example, an appropriate time may be determined with appropriate inputs using the software package DICTRA.

The metallurgical bonding of the bonding region refers to the admixtures that provide the composition of the layers and/or regions of the bonding region being joined through a conformance of lattice structures, such that the lattice structure between a first layer and/or region and a second layer and/or region gradually changes from the lattice structure of the first layer and/or region to the lattice structure of the second layer and/or region, and such that the lattice structures over the bonding region gradually change from the lattice and composition of the substrate to the lattice and composition of the partially sintered particle. In a particular embodiment, the substrate comprises an FCC lattice, the HTA powder particles and the partially sintered particles comprise an FCC lattice, and the bonding region comprises an FCC lattice. In another embodiment, the first metal comprising the HTA powder particles is nickel, aluminum, or a combination, and a second metal comprising the substrate is nickel, aluminum, or a combination. In a further embodiment, the bonding region comprises a Ni—Al solid solution in an FCC lattice, where the lattice points of the FCC lattice comprise Ni and Al.

Here, "bonding region" means a volume of material between the surface of the substrate and a partially sintered particle where the volume of material is comprised of an admixture as defined, and where the volume of material exhibits a conformance of lattice structures such that the lattice structure between a first layer and/or region and a second layer and/or region gradually changes from the lattice structure of the first layer and/or region to the lattice structure of the second layer and/or region throughout the bonding region, and such that the lattice structures over the bonding region gradually change from the lattice and composition of the substrate to the lattice and composition of the partially sintered particle. Further, "metallurgically bonded" with respect to a substrate and a porous HTA layer means that the substrate and the porous HTA layer exhibit metallurgical bonding with a bonding region. The composition and lattice structure of the bonding region may be determined through means known in the art, for example energy-dispersive X-ray spectroscopy (EDX) and X-ray diffraction (XRD).

In a particular embodiment, the partially sintered particles are metallurgically bonded to the substrate through particle-to-substrate necks having a particle-to-substrate neck size ratio, where the particle-to-substrate neck size ratio means the ratio of a particle-to-substrate neck size $X_{S-P}$ to the equivalent spherical diameter of the HTA powder particles utilized, and the porous HTA layer and substrate exhibit an average particle-to-substrate neck size ratio of at least 0.1 and less than 0.5. For example, FIG. 3 illustrates a particle-to-substrate neck between partially sintered particle 317 and substrate 301 and having a size indicated as $X_{S-P}$. The particle-to-substrate size ratio with respect to indicated particle-to-substrate neck is expressed as $X_{S-P}/D$, where D is the equivalent spherical diameter as before. Similarly, an "average particle-to-substrate neck size ratio" means an average value of $X_{S-P}/D$ over at least 50 observed particle-to-substrate necks. The particle-to-substrate necks may be observed and measured using means known in the art, such as scanning electron microscopy.

As discussed, the HTA powder particles utilized in the powder mixture are comprised of at least 10 wt. % of an oxidizing element of aluminum, chromium, silicon or mixtures thereof, and as discussed, the partial sintering which generates the porous HTA layer is conducted in an atmosphere having an oxygen content of less than 1 ppm. Typically, the partial sintering is conducted in a vacuum. The limitation of oxygen during the partial sintering serves to greatly mitigate any diffusion of the oxidizing element within the HTA powder particles toward the surface of the particles, and to greatly mitigate the potential and subsequent formation of alumina, chromia, or silica on particle surfaces during neck formation. Such oxides are known to hinder the sintering process. See e.g., Munir, "Analytical treatment of the role of surface oxide layers in the sintering of metals," *Journal of Materials Science* 14 (1979), among others. Within this methodology, limiting oxygen presence during the partial sintering step serves to prevent surface oxide formation and promote diffusion of metal from respective HTA powder particles into neck regions, allowing the formation of necks largely devoid of oxides. This also serves to maintain the surfaces of the partially sintered particles and necks largely surface oxide free, so that a relatively uniform and adherent oxide scale may be generated on the resulting pore surfaces of the porous HTA layer in a subsequent step.

Within the methodology disclosed, the partial sintering step transforms the debinded layer to a porous HTA layer comprising a plurality of pores such as pore 105 and further comprising pore surfaces such as pore surface 106, and additionally transforms the debinded substrate to a porous HTA layered substrate, where the porous HTA layered substrate comprises the substrate and the porous HTA layer.

Oxidizing the Porous HTA Layered Substrate and Generating the Oxidized Porous HTA Layer on the Substrate:

Following the partial sintering, the thus produced porous HTA layered substrate is oxidized by exposure to a second temperature and a second atmosphere, where the second temperature is less than the first temperature, and where the second atmosphere comprises greater than 1 and less than 10000 ppm $O_2$. Limiting the oxygen content within this range grows the surface oxide slowly and limits the amount of growth that occurs in order to mitigate directional strain leading to oxide spalling. In an embodiment, the second temperature is greater than 700° C., and in another embodiment, the second temperature is less than 1000° C. In an embodiment the second atmosphere comprises less than 100 ppm $O_2$, and in another embodiment the balance of the second atmosphere is an inert such as argon. The oxidizing generates an oxidation layer on the pore surfaces and within the plurality of pores, so that the exposed surface of the partially sintered particles and the joining necks are covered with an adherent oxide layer. The oxidation layer is comprised of the oxidizing element of the HTA powder particles initially utilized, such that the oxidation layer comprises alumina, chromia, silica, or mixtures thereof. The oxidation continues until the oxidation layer has an oxidation layer thickness greater than 20 nanometers and less than 500 nanometers, preferably less than 100 nm. An oxidation layer thickness of at least 20 nm acts to ensure substantially full coverage of the exposed surfaces. An oxidation layer thickness less than 500 nm mitigates directional strain leading to oxide spalling, and less than 100 nm provides additional mitigation against such spalling. The oxidation layer thickness may be determined through means known in the art, for example Auger electron spectroscopy (AES).

The adherent oxide layer with the thickness described provides coverage over the exposed areas within the porous HTA layer while concurrently maintaining a porosity between 10% and 40% for effective transpiration cooling. This oxidation layer serves to greatly mitigate any additional sintering of the porous HTA layer which would otherwise be expected in a high temperature environment. See e.g., Muner, *Journal of Materials Science* 14 (1979). Providing the pre-oxidation as disclosed here in order to generate an adherent oxide layer over the exposed surfaces of the partial sintered particles and the joining necks prior to placing the component in high temperature service allows the porous HTA layered substrate to be effectively utilized for transpiration cooling applications under high temperature service conditions with minimal impact on the initial porosity, and minimal impact on the transpiration cooling capability.

As previously discussed, the oxidized porous HTA layer metallurgically bonded to the substrate provides a means to achieve transpiration cooling of the HTA layer when micro-channels such as micro-channel 110 extend through the substrate, and transpiration cooling flows such as flow 112 flow through the interconnected porosity of oxidized porous HTA layer 102. The methodology disclosed here may be effectively utilized for the placement of oxidized porous HTA layers over micro-channel openings on the substrate surface in order to facilitate the transpiration cooling capability, as illustrated at FIG. 4.

Figure 4:
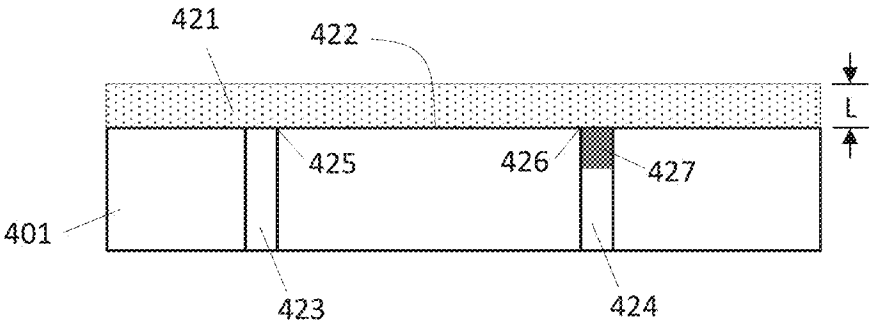
FIG. 4 illustrates a powder mixture applied to a substrate.

FIG. 4 illustrates a substrate 401 having surface 422, and micro-channels 423 and 424 extending through substrate 401. The micro-channels 423 and 424 intersect surface 422 at micro-channel openings in surface 422, such as micro-channel opening 425 where micro-channel 423 intersects surface 422. The micro-channel opening 425 in surface 422 thereby provides a boundary around one end of micro-channel 423. FIG. 4 similarly illustrates micro-channel opening 426 where micro-channel 424 intersects surface 422. In order to incorporate the micro-channels and provide a transpiration fluid path, a fugitive phase material may be placed in the micro-channel openings on the surface of the substrate prior to application of the powder mixture. For example, at FIG. 4, a fugitive phase material 427 is placed within micro-channel opening 426 of micro-channel 424. Following insertion of the fugitive phase material, a powder mixture layer 421 comprised of HTA powder particles and a binder as described is applied to the surface 422 of substrate 401 and additionally over fugitive phase material 427, generating powder mixture layer 421 having a layer thickness L of greater than at least 10 times the equivalent spherical diameter of the HTA powder particles. The fugitive phase may comprise, for example, wax, graphite, or some other material which can be subsequently removed using a thermal or chemical process. The substrate and powder mixture layer can then be processed generally as before with the fugitive phase removed either during or after completion of one of the disclosed steps following the powder mixture application.

The apparatus generated through the steps of the method disclosed is further described with additional reference to FIG. 1. At FIG. 1, a substrate 101 is bonded to an oxidized porous HTA layer generally indicated at 102. Oxidized porous HTA layer 102 comprises a plurality of partially sintered particles, such as partially sintered particles 103 and 104. The individual particles within the plurality are bonded to other, adjacent particles by necks between particles which form during a partial sintering process, such as neck 108 between individually sintered particles 103 and 104. The neck between particles is such that an average neck size ratio is at least 0.1 and generally less than 0.5, and necks between adjacent particles are generally present throughout oxidized porous HTA layer 102, such that oxidized porous HTA layer 102 is a substantially rigid structure. Additionally and significantly, the plurality of partially sintered particles are bonded such that oxidized porous HTA layer 102 has a porosity of from about 10% to about 40%, and typically about 20-30%. Oxidized porous HTA layer 102 thereby comprises a plurality of pores and pore surfaces, such as pore 105 with pore surface 106. Additionally, since porosities within the specified ranges are generally interconnected, oxidized porous HTA layer 102 is permeable through the interconnected porosity.

At FIG. 1, the average diameter of the partially sintered particles comprising oxidized porous HTA layer 102 is generally between 100 and 200 μm. This particular sizing allows necks in the neck size ratio specified to possesses sufficient strength in the service environment while concurrently providing a typical porosity of 20-30%. Additionally, oxidized porous HTA layer 102 is metallurgically bonded to substrate 101 through some portion of the partially sintered particles such as partially sintered particle 104. Partially sintered particle 104 is bonded to substrate 101 by a bonding region generally indicated by 109 and characterized by a conformance of lattice structures from the partially sintered particles to the substrate and the presence of a first element from the substrate and a second element from the HTA powder particles. These bonding regions between partially sintered particles and the substrate arises at substantially all points of contact between a partially sintered particle and the substrate, such that oxidized porous HTA layer 102 and substrate 101 are structurally bonded.

Further at FIG. 1, throughout oxidized porous HTA layer 102, the pore surfaces such as pore surface 106 are covered with an oxidation layer of alumina, chromia, or silica at a thickness of from about 20 nanometers to about 500 nanometers. The oxidation layer forms by an oxidation step at low oxygen partial pressure, and greatly mitigates the additional sintering of the porous HTA layer which would otherwise be expected in a high temperature service environment. By mitigating this additional sintering through provision of the oxidation layer arranged as described, the oxidized porous HTA layer 102 may be comprised of particles which structurally bond to substrate 101 and which would otherwise be expected to undergo additional and significant sintering under high temperature service environments. The oxidation layer provided here serves to allow the use of such particles and provides a configuration whereby the particles substantially maintain neck size ratios between 0.1 and 0.5 and typical porosities of 20-30%, such that an interconnected porosity through a layer structurally bonded to the substrate may be maintained during high temperature service.

The oxidized porous HTA layer structurally bonded to the substrate as described provides a means by which to achieve transpiration cooling of the HTA layer and substrate when the substrate includes one or more micro-channels such as micro-channel 110 in fluid communication with an interior cooling channel such as interior channel 111. Within such an arrangement and under a positive pressure, transpiration cooling flows such as those generally indicated at 112 may arise from interior channel 111 and micro-channel 110 to flow through the interconnected porosity of oxidized porous HTA layer 102 in order to effectively remove heat and maintain substrate 101 at a reduced temperature.

Thus, disclosed here is a method and apparatus for generating transpiration cooling using an oxidized porous HTA layer metallurgically bonded to a substrate having micro-channel architectures. The method and apparatus generates a porous HTA layer by spreading generally spherical HTA powder particles on a substrate, partially sintering under $O_2$ vacuum until the porous HTA layer exhibits a porosity between 10% and 40% and a neck size ratio between 0.1 and 0.5, followed by a controlled oxidation generating an oxidation layer of alumina, chromia, or silica at a thickness of about 20 to about 500 nm, in order to mitigate additional sintering during high temperature service. The requirements provide sufficient porosity for effective cooling of the porous HTA layer via transpiration while concurrently providing sufficient strength between particles in the porous HTA layer and metallurgical bonding to the substrate, so that the porous HTA layer maintains structural integrity under the loads expected in service. The method and apparatus thereby provides an oxidized porous HTA layer on the substrate such that the specified porosity of the layer allows transpiration cooling during high temperature service while the thin oxidation layer acts to maintain this porosity during service life, due to the tendency of the oxidation layer to mitigate the additional sintering in service that would otherwise be expected.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A method of generating an oxidized porous alloy layer on a substrate comprising:

obtaining a powder mixture, where the powder mixture comprises alloy powder particles and a binder, where the alloy powder particles comprise an oxidizing element, where the oxidizing element is aluminum, chromium, silicon or mixtures thereof, and where an individual alloy powder is at least 5 wt. % of the oxidizing element, and where the alloy powder particles have an equivalent spherical diameter of greater than 50 micron and less than about 400 micron and a span equal to less than 0.8, and where the alloy powder particles have a solidus temperature $T_S$, and where the binder is less than about 40 wt. % of the powder mixture;

applying the powder mixture to a surface of the substrate and generating a powder mixture layer having a layer thickness of greater than at least 10 times the equivalent spherical diameter on the surface of the substrate, thereby generating a covered substrate, where the covered substrate comprises the substrate and the powder mixture layer;

exposing the covered substrate to a debinding temperature and debinding the powder mixture layer generating a debinded layer, thereby generating a debinded covered substrate, where the debinded covered substrate comprises the substrate and the debinded layer;

partially sintering the debinded covered substrate by subjecting the debinded covered substrate to a first temperature in a first atmosphere, where the first temperature is from about 0.6 to about 0.95 of the solidus temperature $T_S$, and the first atmosphere has an oxygen content of less than 1 ppm, and continuing the partial sintering until the debinded layer exhibits a porosity of greater than about 20% and less than about 50% and an average neck size ratio of at least 0.1 and less than 0.5, thereby generating a porous alloy layer comprising a plurality of pores and comprising pore surfaces, and continuing the partial sintering until the substrate and the porous alloy layer are metallurgically bonded by an admixture of a first metal comprising the alloy powder particles and a second metal comprising the substrate, thereby generating a porous alloy layered substrate, where the porous alloy layered substrate comprises the substrate and the porous alloy layer; and forming an oxidation layer on some portion of the pore surfaces by exposing the porous alloy layered substrate to a second temperature in a second atmosphere, where the second temperature is less than the first temperature, and where the second atmosphere comprises greater than 1 and less than 10000 ppm $O_2$, where the oxidation layer comprises some portion of the oxidizing element and comprises alumina, chromia, silica or mixtures thereof, and continuing the forming until the oxidation layer has an oxidation layer thickness greater than 20 nanometers and less than 500 nanometers, thereby generating the oxidized porous alloy layer on the substrate.

2. The method of claim 1 further comprising:

placing a fugitive phase material in a micro-channel opening on the surface of the substrate; and applying the powder mixture to the fugitive phase material, such that the powder mixture covers the micro-channel opening.

3. The method of claim 1 where the alloy powder particles have a sphericity of from about 0.8 to about 1.2.

4. The method of claim 3 where the oxidation layer thickness is less than 100 nanometers.

5. The method of claim 4 where the alloy powder particles have an equivalent spherical diameter of greater than about 75 micron and less than about 150 micron.

6. The method of claim 5 where the porosity is greater than about 30%.

7. The method of claim 1 where the second atmosphere comprises greater than 1 and less than 100 ppm $O_2$, and where the second temperature is from about 600° C. to about 1100° C.

8. The method of claim 1 further comprising continuing the partial sintering until the substrate and the porous alloy layer are metallurgically bonded by an admixture of a first metal comprising the alloy powder particles and a second metal comprising the substrate.

9. The method of claim 8 further comprising continuing the partial sintering for a partial sintering time at the first temperature, where the partial sintering time at the first temperature generates atomic diffusion of the first metal or the second metal or both over a distance of at least one-half of the equivalent spherical diameter of the alloy powder particles.

10. The method of claim 9 further comprising obtaining the powder mixture where the alloy powder particles comprise nickel as a majority element in the alloy powder particles, and further comprising applying the powder mixture to the surface of the substrate where the substrate comprises nickel as a majority element in the substrate.

11. The method of claim 10 further comprising continuing the partial sintering until the admixture of the first metal and the second metal comprises a Ni—Al solid solution in an FCC lattice, where the lattice points of the FCC lattice comprise Ni and Al.

12. A method of generating an oxidized porous alloy layer on a substrate comprising:

obtaining a powder mixture, where the powder mixture comprises alloy powder particles and a binder, where the alloy powder particles comprise an oxidizing element, where the oxidizing element is aluminum, chromium, silicon or mixtures thereof, and where an individual alloy powder is at least 5 wt. % of the oxidizing element, and where the alloy powder particles have an equivalent spherical diameter of greater than about 50 micron and less than about 400 micron and a span equal to less than 0.8, and where the alloy powder particles have a sphericity of from about 0.8 to about 1.2, and where the alloy powder particles have a solidus temperature $T_S$, and where the binder is less than 40 wt. % of the powder mixture;

retrieving a substrate where the substrate comprises a micro-channel opening on a surface of the substrate;

applying the powder mixture to the surface of the substrate and generating a powder mixture layer having a layer thickness on the surface of the substrate of greater than at least 10 times the equivalent spherical diameter, and covering the micro-channel opening on the surface of the substrate with the powder mixture, thereby generating a covered substrate, where the covered substrate comprises the substrate, the powder mixture layer, and the powder mixture covering the micro-channel opening;

exposing the covered substrate to a debinding temperature and debinding the powder mixture layer generating a debinded layer, thereby generating a debinded covered substrate, where the debinded covered substrate comprises the substrate and the debinded layer;

partially sintering the debinded covered substrate by subjecting the debinded covered substrate to a first temperature in a first atmosphere, where the first temperature is from about 0.6 to about 0.95 of the solidus temperature $T_S$, and the first atmosphere has an oxygen content of less than 1 ppm, and continuing the partial sintering until the debinded layer exhibits a porosity of greater than about 20% and less than about 50% and an average neck size ratio of at least 0.1 and less than 0.5, thereby generating a porous alloy layer comprising a plurality of pores and comprising pore surfaces, and continuing the partial sintering until the substrate and the porous HTA layer are metallurgically bonded by an admixture of a first metal comprising the HTA powder particles and a second metal comprising the substrate, thereby generating a porous alloy layered substrate, where the porous alloy layered substrate comprises the substrate and the porous alloy layer; and forming an oxidation layer on some portion of the pore surfaces by exposing the porous alloy layered substrate to a second temperature in a second atmosphere, where the second temperature is less than the first temperature, and where the second atmosphere comprises greater than 1 and less than 10000 ppm $O_2$, where the oxidation layer comprises some portion of the oxidizing element and comprises alumina, chromia, silica or mixtures thereof, and continuing the forming until the oxidation layer has an oxidation layer thickness greater than 20 nanometers and less than 500 nanometers, thereby generating the oxidized porous alloy layer on the substrate.

13. The method of claim 12 where the oxidation layer thickness is less than 100 nanometers.

14. The method of claim 13 where the porosity is greater than about 30%.

15. The method of claim 14 further comprising continuing the partial sintering until the substrate and the porous alloy layer are metallurgically bonded by an admixture of a first metal comprising the alloy powder particles and a second metal comprising the substrate.

16. The method of claim 15 further comprising obtaining the powder mixture where the alloy powder particles comprise nickel as a majority element in the alloy powder particles, and further comprising applying the powder mixture to the surface of the substrate where the substrate comprises nickel as a majority element in the substrate.

17. The method of claim 16 further comprising continuing the partial sintering until the admixture of the first metal and the second metal comprises a Ni—Al solid solution in an FCC lattice, where the lattice points of the FCC lattice comprise Ni and Al.

* * * * *